US007685816B2

(12) United States Patent
Yabuki

(10) Patent No.: US 7,685,816 B2
(45) Date of Patent: Mar. 30, 2010

(54) COOLING SYSTEM FOR CONSTRUCTION MACHINE

(75) Inventor: Yasuhisa Yabuki, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 482 days.

(21) Appl. No.: 11/658,910

(22) PCT Filed: Dec. 22, 2005

(86) PCT No.: PCT/JP2005/023608

§ 371 (c)(1),
(2), (4) Date: Jan. 30, 2007

(87) PCT Pub. No.: WO2006/112091

PCT Pub. Date: Oct. 26, 2006

(65) Prior Publication Data

US 2009/0217655 A1 Sep. 3, 2009

(30) Foreign Application Priority Data

Apr. 7, 2005 (JP) ..... 2005-110487

(51) Int. Cl.
*F01P 5/04* (2006.01)
*F01P 7/04* (2006.01)

(52) U.S. Cl. ..... 60/456

(58) Field of Classification Search ..... 60/456; 236/34

See application file for complete search history.

(56) References Cited

U.S. PATENT DOCUMENTS 6,076,488 A * 6/2000 Yamagishi ..... 123/41.12
6,311,488 B1 * 11/2001 Maruta et al. ..... 60/456
6,349,882 B1 * 2/2002 Kita et al. ..... 236/34
6,481,388 B1 * 11/2002 Yamamoto ..... 123/41.12
6,959,671 B2 * 11/2005 Nakagawa et al. ..... 60/493
7,281,370 B2 * 10/2007 Furuta et al. ..... 60/456
7,373,239 B2 * 5/2008 Kamado et al. ..... 701/103

FOREIGN PATENT DOCUMENTS

JP 62-050219 3/1987
JP 62050219 A * 3/1987

(Continued)

*Primary Examiner*—Thomas E Lazo
(74) *Attorney, Agent, or Firm*—Mattingly & Malur, P.C.

(57) ABSTRACT

A cooling system for a construction machine, which can reduce noise of a cooling fan and can reliably produce cooling air at a required flow rate.

The cooling system comprises a cooling fan 25 for producing cooling air introduced to an intercooler 22, a radiator 23 and an oil cooler 24, a fan hydraulic motor 26 for driving the cooling fan 25, a fan hydraulic pump 27 for delivering a hydraulic fluid to the fan hydraulic motor 26, an air temperature sensor 31 for detecting an air temperature $T_1$ at an outlet of the intercooler 22, a cooling water temperature sensor 33 for detecting a temperature $T_2$ of cooling water for the radiator 23, a working oil temperature sensor 36 for detecting a temperature $T_3$ of working oil for the oil cooler 24, and a controller 29 for outputting a control signal corresponding to a maximum value among calculation values $N_1$, $N_2$ and $N_3$ of cooling fan rotation speed, which correspond respectively to detected values $T_1$, $T_2$ and $T_3$ from the air temperature sensor 31, the cooling water temperature sensor 33 and the working oil temperature sensor 36.

5 Claims, 10 Drawing Sheets

FOREIGN PATENT DOCUMENTS

| | | | | |
|---|---|---|---|---|
| JP | 11-294162 | | | 10/1999 |
| JP | 11294162 | A | * | 10/1999 |
| JP | 2000-110560 | | | 4/2000 |
| JP | 2000110560 | A | * | 4/2000 |
| JP | 2000-274243 | A | | 10/2000 |
| JP | 2001-182535 | | | 7/2001 |
| JP | 2004-353554 | | | 12/2004 |
| JP | 2004353554 | A | * | 12/2004 |

* cited by examiner

COOLING SYSTEM FOR CONSTRUCTION MACHINE

TECHNICAL FIELD

The present invention relates to a construction machine such as a hydraulic excavator, and more particularly to a cooling system for a construction machine, which includes a cooling fan for producing cooling air introduced to heat exchangers such as an intercooler, a radiator, and an oil cooler.

BACKGROUND ART

In a construction machine, e.g., a hydraulic excavator, a front operating mechanism including a boom, an arm, a bucket, etc. and an upper swing body are operated by hydraulic actuators, e.g., a hydraulic cylinder and a hydraulic motor. Those hydraulic actuators are operated by a hydraulic fluid delivered from a hydraulic pump which is driven by an engine. The upper swing body is covered with a cover, and the engine and the hydraulic pump are disposed in an engine room formed within the cover. In that type of construction machine, it is usual that, for the purpose of cooling the engine, a cooling fan disposed in the engine room is driven to introduce open air through intake holes formed in the cover, thereby producing cooling air. As the cooling fan, the so-called axial fan (propeller fan) rotated by a driving force from an engine crankshaft is used in many cases. The cooling air produced by the cooling fan is introduced into the engine room and passes through various heat exchangers for cooling them, and is then discharged to the exterior of the engine room through discharge holes formed in the cover. The heat exchangers include, for example, an intercooler for cooling compressed air pressurized by a turbocharger which is mounted on the engine, a radiator for cooling engine cooling water, and an oil cooler for cooling working oil in a hydraulic driving system.

In the above-described cooling fan directly driven by the engine, the rotation speed of the cooling fan is proportional to the engine revolution speed. Therefore, it may occur sometimes that the cooling water for the radiator and the working oil for the oil cooler are overcooled and a longer time is taken for warm-up operation. To avoid such a drawback, a system for driving the cooling fan independently of the engine revolution has hitherto been proposed, for example, which comprises a cooling fan for forcibly cooling a radiator and an oil cooler, a fan hydraulic motor for driving the cooling fan, a variable-displacement fan hydraulic pump capable of controlling the rotation speed of the fan hydraulic motor, a cooling water temperature sensor for detecting the temperature of cooling water, a working oil temperature sensor for detecting the temperature of working oil, an engine revolution speed sensor for detecting the revolution speed of an engine, and a controller for receiving signals detected by those sensors, calculating and outputting a delivery displacement command value for the fan hydraulic pump depending on the cooling water temperature, the working oil temperature and the engine revolution speed, and continuously controlling the rotation speed of the cooling fan by the variable-displacement fan hydraulic pump (see, e.g., Patent Document 1).

Patent Document 1: JP, A 2001-182535

DISCLOSURE OF THE INVENTION

Problems to be Solved by the Invention

Recently, criteria of noise regulation (EN) in Europe have become severe more and more. For that reason, when the cooling fan directly driven by the engine is mounted, particularly, on a large-sized hydraulic excavator or the like which requires a large cooling capability, there is a limitation in reducing noise only by improving other components than the cooling fan which occupies a large part of the noise cause (for example, by improving a soundproof member, a soundproof structure, etc. provided in the engine room), thus resulting in a difficulty in meeting the criteria of the noise regulation.

In the above-described related art, the hydraulically driven cooling fan is disposed to forcibly cool the radiator and the oil cooler, and the rotation speed of the cooling fan is controlled depending on the cooling water temperature, the working oil temperature, and the engine revolution speed. However, the above-cited Patent Document 1 does not clearly describe cooling of the intercooler. Let here assume, for example, the case where the hydraulically driven cooling fan is provided to cool not only the radiator and the oil cooler, but also the intercooler by the cooling air produced by the cooling fan. In that case, when the cooling water temperature and the working oil temperature are low, for example, at startup of the engine, the rotation speed of the cooling fan is low even in a state that the temperature of open air is high. This leads to a possibility that the cooling air is not obtained at a flow rate required for the intercooler. Accordingly, there is still room for further improvement.

The present invention has been accomplished in view of the above-mentioned state of the art, and its object is to provide a cooling system for a construction machine, which can reduce noise of a cooling fan and can reliably produce cooling air at a required flow rate.

Means for Solving the Problems (1) To achieve the above object, the present invention provides a cooling system for a construction machine, wherein the cooling system comprises an intercooler for cooling compressed air pressurized by a turbo charger which is mounted on an engine; a radiator for cooling water to cool the engine; an oil cooler for cooling working oil for a hydraulic driving system; a cooling fan for producing cooling air introduced to the intercooler, the radiator and the oil cooler; a fan hydraulic motor for driving the cooling fan; a fan hydraulic pump for delivering a hydraulic fluid to the fan hydraulic motor; air temperature detecting means for detecting an air temperature at an outlet of the intercooler; cooling water temperature detecting means for detecting a temperature of cooling water for the radiator; working oil temperature detecting means for detecting a temperature of working oil for the oil cooler; and control means for receiving detected values from the air temperature detecting means, the cooling water temperature detecting means and the working oil temperature detecting means, and outputting a control signal corresponding to a maximum value among calculation values of cooling fan rotation speed, which correspond respectively to the detected values.

In the present invention, the cooling system for the construction machine includes the cooling fan for producing cooling air introduced to the intercooler, the radiator and the oil cooler, the fan hydraulic motor for driving the cooling fan, and the fan hydraulic pump, which is, e.g., of variably displacement type, for delivering the hydraulic fluid to the fan hydraulic motor. The control means calculates a cooling fan rotation speed for the intercooler corresponding to the air temperature at the outlet of the intercooler, which is detected by the air temperature detecting means, a cooling fan rotation speed for the radiator corresponding to the temperature of the cooling water for the radiator, which is detected by the cooling water temperature detecting means, and a cooling fan rotation speed for the oil cooler corresponding to the temperature of the working oil for the oil cooler, which is detected by the working oil temperature detecting means. Further, the control means selects a maximum value among those calculation values of the cooling fan rotation speed and outputs a control signal corresponding to the selected maximum value, thereby controlling the delivery displacement of the fan hydraulic pump, for example. As a result, the fan hydraulic motor is driven and the cooling fan rotation speed is controlled to be, for example, continuously changed.

Thus, according to the present invention, since the cooling fan rotation speed is controlled depending on the air temperature at the outlet of the intercooler, the temperature of the cooling water for the radiator, and the temperature of the working oil for the oil cooler, the cooling air can be reliably produced at a flow rate required for the intercooler, the radiator and the oil cooler. In addition, as compared with, for example, the case where the cooling fan directly driven by the engine is provided, it is possible to prevent a useless increase of the cooling fan rotation speed and to reduce noise of the cooling fan to a lower level.

(2) To achieve the above object, the present invention also provides a cooling system for a construction machine, wherein the cooling system comprises an intercooler for cooling compressed air pressurized by a turbo charger which is mounted on an engine; a radiator for cooling water to cool the engine; an oil cooler for cooling working oil for a hydraulic driving system; a condenser for cooling a coolant of an air conditioner for a cab; a cooling fan for producing cooling air introduced to the intercooler, the radiator, the oil cooler and the condenser; a fan hydraulic motor for driving the cooling fan; a fan hydraulic pump for delivering a hydraulic fluid to the fan hydraulic motor; air temperature detecting means for detecting an air temperature at an outlet of the intercooler; cooling water temperature detecting means for detecting a temperature of cooling water for the radiator; working oil temperature detecting means for detecting a temperature of working oil for the oil cooler; open air temperature detecting means for detecting an open air temperature; and control means for, when the air conditioner is driven, receiving detected values from the air temperature detecting means, the cooling water temperature detecting means, the working oil temperature detecting means and the open air temperature detecting means, and outputting a control signal corresponding to a maximum value among calculation values of cooling fan rotation speed, which correspond respectively to the detected values, and for, when the air conditioner is stopped, receiving the detected values from the air temperature detecting means, the cooling water temperature detecting means and the working oil temperature detecting means, and outputting a control signal corresponding to a maximum value among the calculation values of the cooling fan rotation speed, which correspond respectively to the detected values.

In the present invention, the cooling system for the construction machine includes the condenser for cooling the coolant of the air conditioner for the cab in addition to the construction of above (1). Similarly to the intercooler, the radiator and the oil cooler, the condenser is also cooled by the cooling air produced by the cooling fan which is driven by the fan hydraulic motor. When the air conditioner is stopped, the control means executes control in the same manner as that in above (1). More specifically, the control means calculates the respective cooling fan rotation speeds for the intercooler, the radiator and the oil cooler corresponding to the detected values from the air temperature detecting means, the cooling water temperature detecting means, and the working oil temperature detecting means. Further, the control means selects a maximum value among those calculation values of the cooling fan rotation speed and outputs a control signal corresponding to the selected maximum value, thereby controlling the delivery displacement of the fan hydraulic pump, for example. On the other hand, when the air conditioner is driven, the control means calculates the respective cooling fan rotation speeds for the intercooler, the radiator and the oil cooler, and also calculates a cooling fan rotation speed for the condenser corresponding to the open air temperature detected by the open air temperature detecting means. Further, the control means selects a maximum value among those calculation values of the cooling fan rotation speed and outputs a control signal corresponding to the selected maximum value, thereby controlling the delivery displacement of the fan hydraulic pump, for example. As a result, the fan hydraulic motor is driven and the cooling fan rotation speed is controlled to be, for example, continuously changed.

Thus, according to the present invention, when the air conditioner is stopped, the cooling air can be reliably produced at a flow rate required for the intercooler, the radiator and the oil cooler as in above (1). On the other hand, when the air conditioner is driven, the cooling air can be reliably produced at a flow rate required for the intercooler, the radiator, the oil cooler, and the condenser. In addition, as compared with, for example, the case where the cooling fan directly driven by the engine is provided, it is possible to prevent a useless increase of the cooling fan rotation speed and to reduce noise of the cooling fan to a lower level as in above (1).

(3) To achieve the above object, the present invention further provides a cooling system for a construction machine, wherein the cooling system comprises an intercooler for cooling compressed air pressurized by a turbo charger which is mounted on an engine; a radiator for cooling water to cool the engine; an oil cooler for cooling working oil for a hydraulic driving system; a condenser for cooling a coolant of an air conditioner for a cab; a cooling fan for producing cooling air introduced to the intercooler, the radiator, the oil cooler and the condenser; a fan hydraulic motor for driving the cooling fan; a fan hydraulic pump for delivering a hydraulic fluid to the fan hydraulic motor; air temperature detecting means for detecting an air temperature at an outlet of the intercooler; cooling water temperature detecting means for detecting a temperature of cooling water for the radiator; working oil temperature detecting means for detecting a temperature of cooling water for the oil cooler; open air temperature detecting means for detecting an open air temperature; engine revolution speed detecting means for detecting an engine revolution speed of the engine; and control means for, when the air conditioner is driven, outputting a control signal corresponding to a maximum value among calculation values of cooling fan rotation speed, which correspond respectively to detected values from the air temperature detecting means, the cooling water temperature detecting means, the working oil temperature detecting means and the open air temperature detecting means, and among a lower limit value of the cooling fan rotation speed, which corresponds to a detected value from the engine revolution speed detecting means, and for, when the air conditioner is stopped, outputting a control signal corresponding to a maximum value among the calculation values of the cooling fan rotation speed, which correspond respectively to the detected values from the air temperature detecting means, the cooling water temperature detecting means and the working oil temperature detecting means.

Depending on the engine revolution speed, the delivery displacement of the fan hydraulic pump varies and the cooling fan rotation speed also varies correspondingly. In other words, when the engine revolution speed is reduced, the cooling capability of each of the intercooler, the radiator, the oil cooler, and the condenser is deteriorated. However, it is demanded to suppress deterioration in the cooling capability of the condenser in the air conditioner in which there is a possibility that a load is increased even when the engine revolution speed is low such as during low idle operation, for example. Taking into account that demand, in the present invention, when the air conditioner is driven, the control means calculates the respective cooling fan rotation speeds for the intercooler, the radiator, the oil cooler and the condenser corresponding to the detected values from the air temperature detecting means, the cooling water temperature detecting means, the working oil temperature detecting means, and the open air temperature detecting means, and also calculates the lower limit value of the cooling fan rotation speed which corresponds to the detected value from the engine revolution speed detecting means (e.g., a lower limit value increasing with a decrease of the engine revolution speed). Further, the control means selects a maximum value among those calculation values and the lower limit value of the cooling fan rotation speed and outputs a control signal corresponding to the selected maximum value, thereby controlling the delivery displacement of the fan hydraulic pump, for example. According to the present invention, therefore, in addition to the advantages described in above (2), deterioration in the cooling capability of, e.g., the condenser due to a decrease of the engine revolution speed can be suppressed by controlling the cooling fan rotation speed so as not to reduce below the lower limit value.

(4) In any one of above (1) to (3), preferably, the control means controls the rotation speed of the cooling fan by variably controlling delivery displacement of the fan hydraulic pump.

(5) In any one of above (1) to (3), preferably, the control means controls the rotation speed of the cooling fan by variably controlling displacement of the fan hydraulic motor.

(6) In any one of above (1) to (3), preferably, the control means controls the cooling fan rotation speed to be continuously changed.

(7) In any one of above (1) to (3), preferably, the control means controls the cooling fan rotation speed to be stepwisely changed.

ADVANTAGES OF THE INVENTION

According to the present invention, it is possible to reduce noise of the cooling fan and to reliably produce the cooling air at a required flow rate.

REFERENCE NUMERALS

Figure 1:
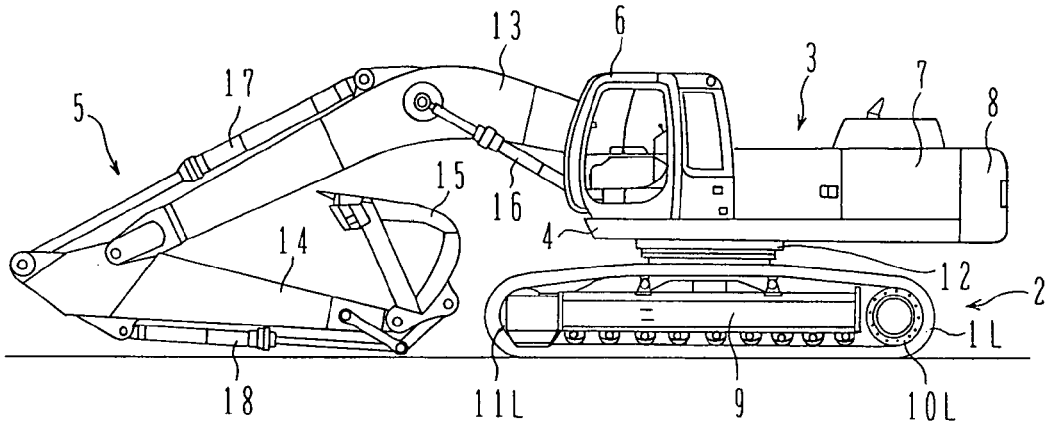
FIG. 1 is a side view showing an overall structure of a hydraulic excavator as one example of a construction machine to which is applied the present invention.

19 engine
22 intercooler
23 radiator
24 oil cooler
25 cooling fan
26 fan hydraulic motor
27 fan hydraulic pump
29 controller (control means)
31 air temperature sensor (air temperature detecting means)
33 cooling water temperature sensor (cooling water temperature detecting means)
36 working oil temperature sensor (working oil temperature detecting means)
38 turbo charger
40 air conditioner

41 condenser

43 open air temperature sensor (open air temperature detecting means)

44 controller (control means)

44A controller (control means)

45 engine revolution speed sensor (engine revolution speed detecting means)

E engine revolution speed $N_1$ first calculation value of cooling fan rotation speed $N_2$ second calculation value of cooling fan rotation speed $N_3$ third calculation value of cooling fan rotation speed $N_4$ fourth calculation value of cooling fan rotation speed $N_5$ lower limit value of cooling fan rotation speed $T_1$ air temperature at intercooler outlet $T_2$ cooling water temperature at radiator inlet $T_3$ working oil temperature at oil cooler outlet $T_4$ open air temperature

BEST MODE FOR CARRYING OUT THE INVENTION

Embodiments of the present invention will be described below with reference to the drawings.

A first embodiment of the present invention will be described below with reference to FIGS. 1-6.

FIG. 1 is a side view showing an overall structure of a large-sized hydraulic excavator to which is applied the present invention. Note that, in the following description, the front side (left side in FIG. 1) looking from an operator, the rear side (right side in FIG. 1), the left side (side viewing the drawing sheet of FIG. 1), and the right side (side behind the drawing sheet of FIG. 1) when the operator sits on a cab seat with the hydraulic excavator being in a state shown in FIG. 1 are referred to simply as the "front side, rear side, left side, and right side", respectively.

Referring to FIG. 1, the large-sized hydraulic excavator comprises a lower travel structure 2 including left and right caterpillar belts (crawlers) 1L, 1R (only 1L being shown in FIG. 1) which serve as traveling means, an upper swing body 3 installed on the lower travel structure 2 in a swingable manner, and a multi-articulated front operating mechanism 5 mounted to a swing frame 4, which constitutes a basic lower structure of the upper swing body 3, in a vertically rotatable manner (i.e., in a manner angularly movable up and down). On the swing frame 4, there are mounted a cab 6 which is disposed in a front left portion of the swing frame 4 and defines an operating room, an upper cover 7 covering a most part of the upper swing body 3 other than the cab 6, and a counterweight 8 which is disposed in a rear portion of the swing frame 4 so as to establish weight balance with respect to the front operating mechanism 5.

The lower travel structure 2 comprises a track frame 9 substantially in the H form, drive wheels 10L, 10R (only 10L being shown in FIG. 1) which are rotatably supported near rear ends of the track frame 9 on the left and right sides of the track frame 9, respectively, left and right travel hydraulic motors (not shown) for driving the drive wheels 10L, 10R, respectively, and driven wheels (idlers) 11L, 11R (only 11L being shown in FIG. 1) which are rotatably supported near front ends of the track frame 9 on the left and right sides of the track frame 9 and are rotated by driving forces of the drive wheels 10L, 10R through the caterpillar belts 1L, 1R, respectively. Further, a swivel bearing (swing wheel) 12 is disposed in a central portion of the lower travel structure 2, and a swing hydraulic motor (not shown) for swinging the swing frame 4 relative to the lower travel structure 2 is disposed on the swing frame 4 near the center of the swing wheel 12.

The front operating mechanism 5 comprises a boom 13 coupled at its base end side to the swing frame 4 in a manner rotatable about a horizontal axial direction, an arm 14 rotatably coupled at its base end side to the fore end side of the boom 13, and a bucket 15 rotatably coupled at its base end side to the fore end side of the arm 14. The boom 13, the arm 14, and the bucket 15 are operated by a pair of left and right boom hydraulic cylinders 16, 16, an arm hydraulic cylinder 17, and a bucket hydraulic cylinder 18, respectively.

In the structure described above, the left and right caterpillar belts 1L, 1R, the upper swing body 3, the boom 13, the arm 14, and the bucket 15 constitute driven members which are driven by the hydraulic driving system installed in the hydraulic excavator.

Figure 2:
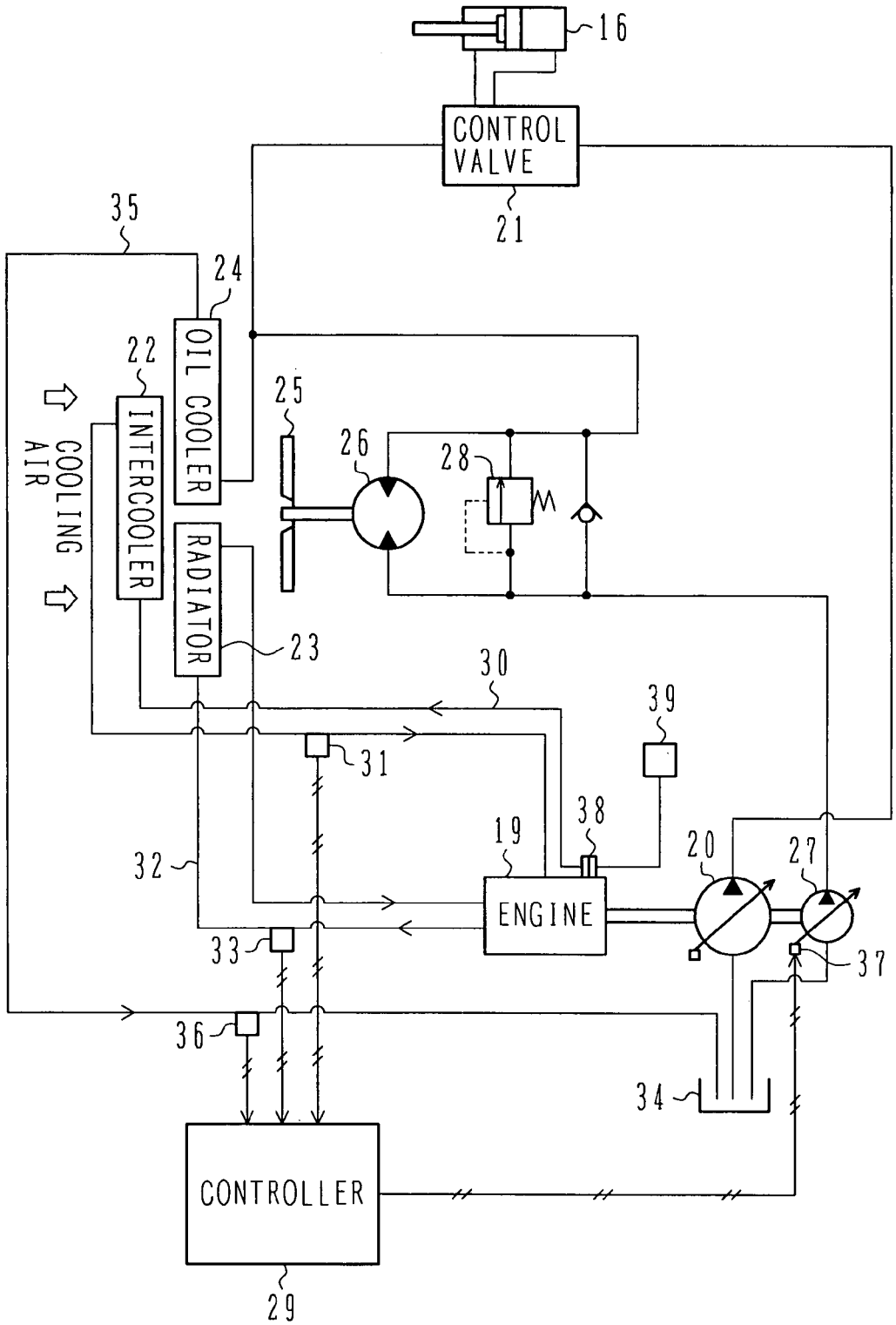
FIG. 2 is a hydraulic circuit diagram showing a first embodiment of a cooling system for the construction machine according to the present invention along with a hydraulic driving system.

FIG. 2 is a hydraulic circuit diagram showing a first embodiment of a cooling system for the construction machine according to the present invention, including, as one example, the arrangement of a principal part of the hydraulic driving system which is related to driving of the boom 13.

In FIG. 2, the hydraulic circuit diagram includes an engine 19, a variable displacement hydraulic pump 20 which is driven by the engine 19, the boom hydraulic cylinder 16 (only representative one being shown in FIG. 2), a control valve 21 for controlling a flow of a hydraulic fluid delivered from the hydraulic pump 20 to the boom hydraulic cylinder 16, an intercooler 22 for cooling compressed air pressurized by a turbo charger 38 which is mounted on the engine 19, a radiator 23 for cooling water to cool the engine 19, an oil cooler 24 for cooling working oil, a cooling fan 25 which is disposed, for example, one (though may be plural) and produces cooling air introduced to the intercooler 22, the radiator 23 and the oil cooler 24, a fan hydraulic motor 26 for driving the cooling fan 25, a variable-displacement fan hydraulic pump 27 which is driven by the engine 19 and delivers the hydraulic fluid to the fan hydraulic motor 26, a relief valve 28 for specifying a maximum value of the delivery pressure of the fan hydraulic pump 27, and a controller 29. The radiator 23 and the oil cooler 24 are arranged side by side in opposed relation to the cooling fan 25, and the intercooler 22 is arranged upstream (left side in FIG. 2) of the radiator 23 and the oil cooler 24 in the direction of flow of the cooling air.

The control valve 21 receives an operation pilot pressure generated depending on operation of a control lever (not shown) in the cab and changes the flow of the hydraulic fluid supplied from the hydraulic pump 20 to the boom hydraulic cylinder 16 in accordance with the operation pilot pressure.

The engine 19 burns, together with fuel, air taken in through an air cleaner 39, the turbo charger 38 and an intake flow passage 30. The intercooler 22 disposed in the intake flow passage 30 cools the compressed air introduced from the turbo charger 38. An air temperature sensor 31 for detecting the air temperature is disposed at an outlet of the intercooler 22, and a detected signal from the air temperature sensor 31 is outputted to the controller 29.

The engine 19 is provided with a cooling line 32 through which the cooling water is circulated by, e.g., a pump (not shown). The radiator 23 disposed in the cooling line 32 cools the cooling water. A cooling water temperature sensor 33 for detecting the temperature of the cooling water is disposed at an inlet of the radiator 23, and a detected signal from the cooling water temperature sensor 33 is outputted to the controller 29. Although the cooling water temperature sensor 33 is disposed at the inlet of the radiator 23 in this embodiment, the present invention is not limited to such an arrangement. For example, the sensor 33 may be disposed at an outlet of the radiator 23.

The oil cooler 24 is disposed in a return line 35 extending from the control valve 21, the hydraulic motor 26, etc. to a working oil reservoir 34, and it cools the working oil. Also, a working oil temperature sensor 36 for detecting the temperature of the working oil is disposed at an outlet of the oil cooler 24, and a detected signal from the working oil temperature sensor 36 is outputted to the controller 29. Although the working oil temperature sensor 36 is disposed at the outlet of the oil cooler 24 in this embodiment, the present invention is not limited to such an arrangement. For example, the sensor 36 may be disposed at an inlet of the oil cooler 24 or in the working oil reservoir 34.

The controller 29 executes predetermined arithmetic and logical operations on the detected signals inputted from the air temperature sensor 31, the cooling water temperature sensor 33, and the working oil temperature sensor 36 based on operation tables (see FIGS. 4-6 described later for details) which have been set and stored in advance, and it outputs a produced control signal to a displacement control unit 37 for the fan hydraulic pump 27. Control steps of the controller 29 will be described below with reference to FIG. 3.

Figure 3:
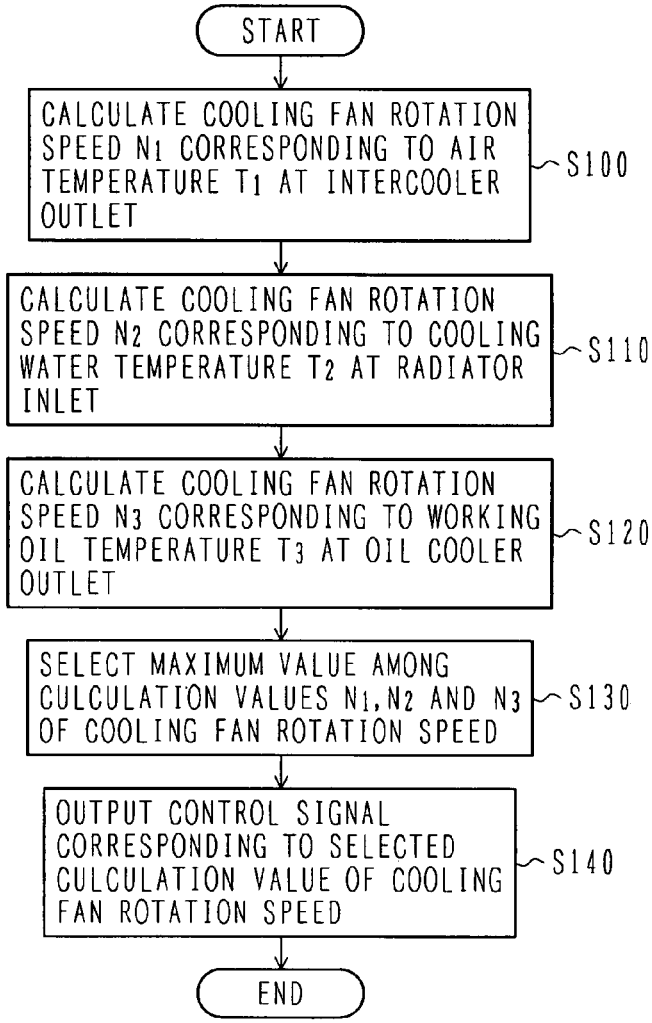
FIG. 3 is a flowchart showing procedures of control processing executed in a controller which constitutes the first embodiment of the cooling system for the construction machine according to the present invention.
Figure 4:
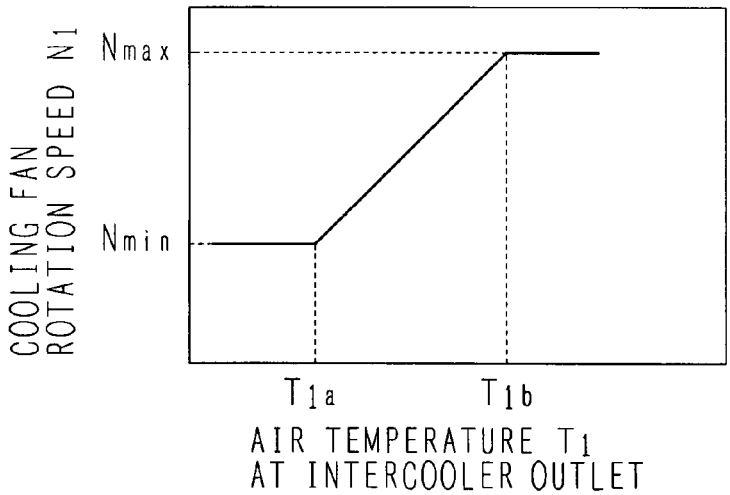
FIG. 4 shows an operation table stored in the controller which constitutes the first embodiment of the cooling system for the construction machine according to the present invention, the table being represented as a characteristic graph plotting the cooling fan rotation speed with respect to the air temperature at an intercooler outlet.
Figure 5:
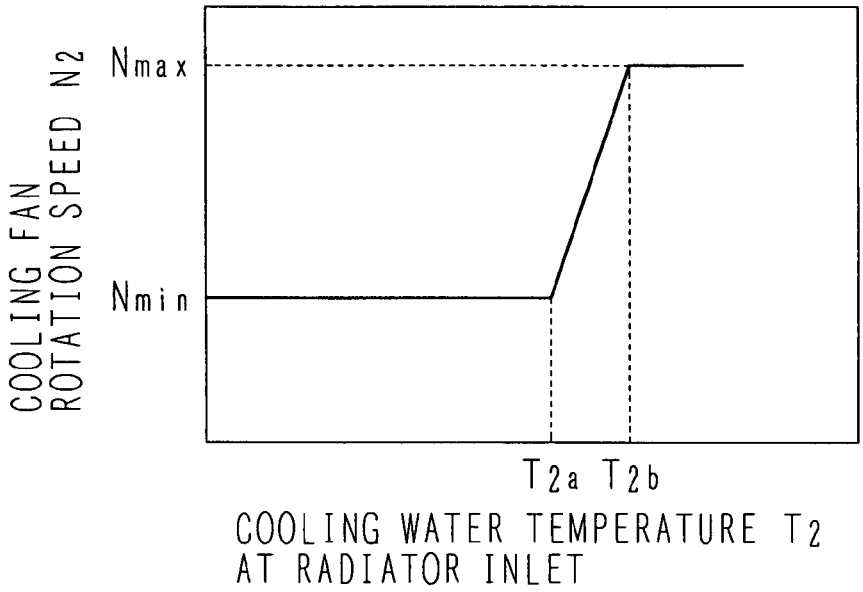
FIG. 5 shows an operation table stored in the controller which constitutes the first embodiment of the cooling system for the construction machine according to the present invention, the table being represented as a characteristic graph plotting the cooling fan rotation speed with respect to the cooling water temperature at a radiator inlet.
Figure 6:
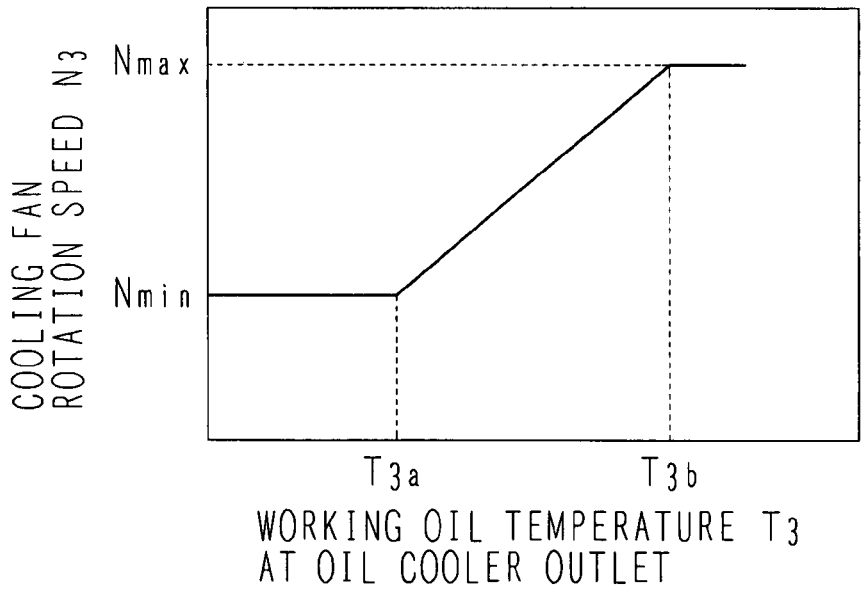
FIG. 6 shows an operation table stored in the controller which constitutes the first embodiment of the cooling system for the construction machine according to the present invention, the table being represented as a characteristic graph plotting the cooling fan rotation speed with respect to the working oil temperature at an oil cooler outlet.

FIG. 3 is a flowchart showing procedures of control processing executed in the controller 29. FIGS. 4-6 show operation tables stored in the controller 29, the tables being represented as characteristic graphs plotting respectively the cooling fan rotation speed with respect to the air temperature at the outlet of the intercooler 22, the cooling fan rotation speed with respect to the cooling water temperature at the inlet of the radiator 23, and the cooling fan rotation speed with respect to the working oil temperature at the outlet of the oil cooler 24.

First, in step 100 of FIG. 3, a first calculation value $N_1$ of the cooling fan rotation speed is calculated corresponding to an air temperature $T_1$ at the outlet of the intercooler 22, which is inputted from the air temperature sensor 31, based on the operation table shown in FIG. 4. More specifically, when the air temperature $T_1$ at the outlet of the intercooler 22 is not higher than a first control air temperature $T_{1a}$, the cooling fan rotation speed $N_1$ is set to a minimum rotation speed $N_{min}$. When the air temperature $T_1$ at the outlet of the intercooler 22 is not lower than a second control air temperature $T_{1b}$, the cooling fan rotation speed $N_1$ is set to a maximum rotation speed $N_{max}$. When the air temperature $T_1$ at the outlet of the intercooler 22 is in the range of $T_{1a}<T_1<T_{1b}$, the cooling fan rotation speed $N_1$ is monotonously increased in the range from the minimum rotation speed $N_{min}$ to the maximum rotation speed $N_{max}$ with an increase of the air temperature $T_1$.

Then, the control flow proceeds to step 110 in which a second calculation value $N_2$ of the cooling fan rotation speed is calculated corresponding to a cooling water temperature $T_2$ at the inlet of the radiator 23, which is inputted from the cooling water temperature sensor 33, based on the operation table shown in FIG. 5. More specifically, when the cooling water temperature $T_2$ at the inlet of the radiator 23 is not higher than a first control cooling water temperature $T_{2a}$, the cooling fan rotation speed $N_2$ is set to a minimum rotation speed $N_{min}$. When the cooling water temperature $T_2$ at the inlet of the radiator 23 is not lower than a second control cooling water temperature $T_{2b}$, the cooling fan rotation speed $N_2$ is set to a maximum rotation speed $N_{max}$. When the cooling water temperature $T_2$ at the inlet of the radiator 23 is in the range of $T_{2a}<T_2<T_{2b}$, the cooling fan rotation speed $N_2$ is monotonously increased in the range from the minimum rotation speed $N_{min}$ to the maximum rotation speed $N_{max}$ with an increase of the cooling water temperature $T_2$.

Then, the control flow proceeds to step 120 in which a third calculation value $N_3$ of the cooling fan rotation speed is calculated corresponding to a working oil temperature $T_3$ at the outlet of the oil cooler 24, which is inputted from the working oil temperature sensor 36, based on the operation table shown in FIG. 6. More specifically, when the working oil temperature $T_3$ at the outlet of the oil cooler 24 is not higher than a first control working oil temperature $T_{3a}$, the cooling fan rotation speed $N_3$ is set to a minimum rotation speed $N_{min}$. When the working oil temperature $T_3$ at the outlet of the oil cooler 24 is not lower than a second control working oil temperature $T_{3b}$, the cooling fan rotation speed $N_3$ is set to a maximum rotation speed $N_{max}$. When the working oil temperature $T_3$ at the outlet of the oil cooler 24 is in the range of $T_{3a}<T_3<T_{3b}$, the cooling fan rotation speed $N_3$ is monotonously increased in the range from the minimum rotation speed $N_{min}$ to the maximum rotation speed $N_{max}$ with an increase of the working oil temperature $T_3$.

Then, the control flow proceeds to step 130 in which a maximum value among the calculation values $N_1$, $N_2$ and $N_3$ of the cooling fan rotation speed is selected. Thereafter, in step 140, a control signal corresponding to the selected maximum value is produced and outputted to the displacement control unit 37 for the fan hydraulic pump 27.

In accordance with the inputted control signal, the displacement control unit 37 for the fan hydraulic pump 27 operates a tilting angle of a swash plate of the fan hydraulic pump 27 (i.e., pump displacement), thereby adjusting delivery displacement per rotation. As a result, the fan hydraulic motor 26 is driven in accordance with the delivery displacement of the fan hydraulic pump 27, and the rotation speed of the cooling fan 25 is controlled so that the cooling fan rotation speed selected in step 130 is obtained.

In the foregoing, the air temperature sensor 31 constitutes air temperature detecting means for detecting the air temperature at the outlet of the intercooler, the cooling water temperature sensor 33 constitutes cooling water temperature detecting means for detecting the temperature of the cooling water for the radiator, and the working oil temperature sensor 36 constitutes working oil temperature detecting means for detecting the temperature of the working oil for the oil cooler, those means being stated in claims. Also, the control functions of the controller 29, shown in FIG. 3, constitute control means for receiving detected values from the air temperature detecting means, the cooling water temperature detecting means and the working oil temperature detecting means, and outputting a control signal corresponding to a maximum value among the calculation values of the cooling fan rotation speed, which correspond respectively to those detected values.

Thus, in this first embodiment constructed as described above, the rotation speed of the cooling fan 25 is controlled depending on the air temperature $T_1$ at the outlet of the intercooler 22, the cooling water temperature $T_2$ at the inlet of the radiator 23, and the working oil temperature $T_3$ at the outlet of the oil cooler 24. Accordingly, the cooling air can be reliably produced at a flow rate required for the intercooler 22, the radiator 23, and the oil cooler 24. In other words, as one example, when the cooling water temperature $T_2$ and the working oil temperature $T_3$ are low and the air temperature $T_1$ is high at startup of the engine, the flow rate of the cooling air required for the intercooler 22 can be ensured. As another example, when the cooling water temperature $T_2$ and the working oil temperature $T_3$ are high and the air temperature $T_1$ is low immediately after stop of the engine, the flow rate of the cooling air required for the radiator 23 and the oil cooler 24 can be ensured.

Further, as compared with, for example, the case where the cooling fan directly driven by the engine is provided, this first embodiment is advantageous in preventing a useless increase of the cooling fan rotation speed, and reducing noise of the cooling fan 22 to a lower level. In addition, since the cooling fan is shared by the intercooler, the radiator, and the oil cooler, the number of parts can be cut and the noise of the cooling fan 22 can be further reduced as a whole.

A second embodiment of the present invention will be described below with reference to FIGS. 7-9. In this second embodiment, a condenser for cooling a coolant of an air conditioner is additionally provided.

Figure 7:
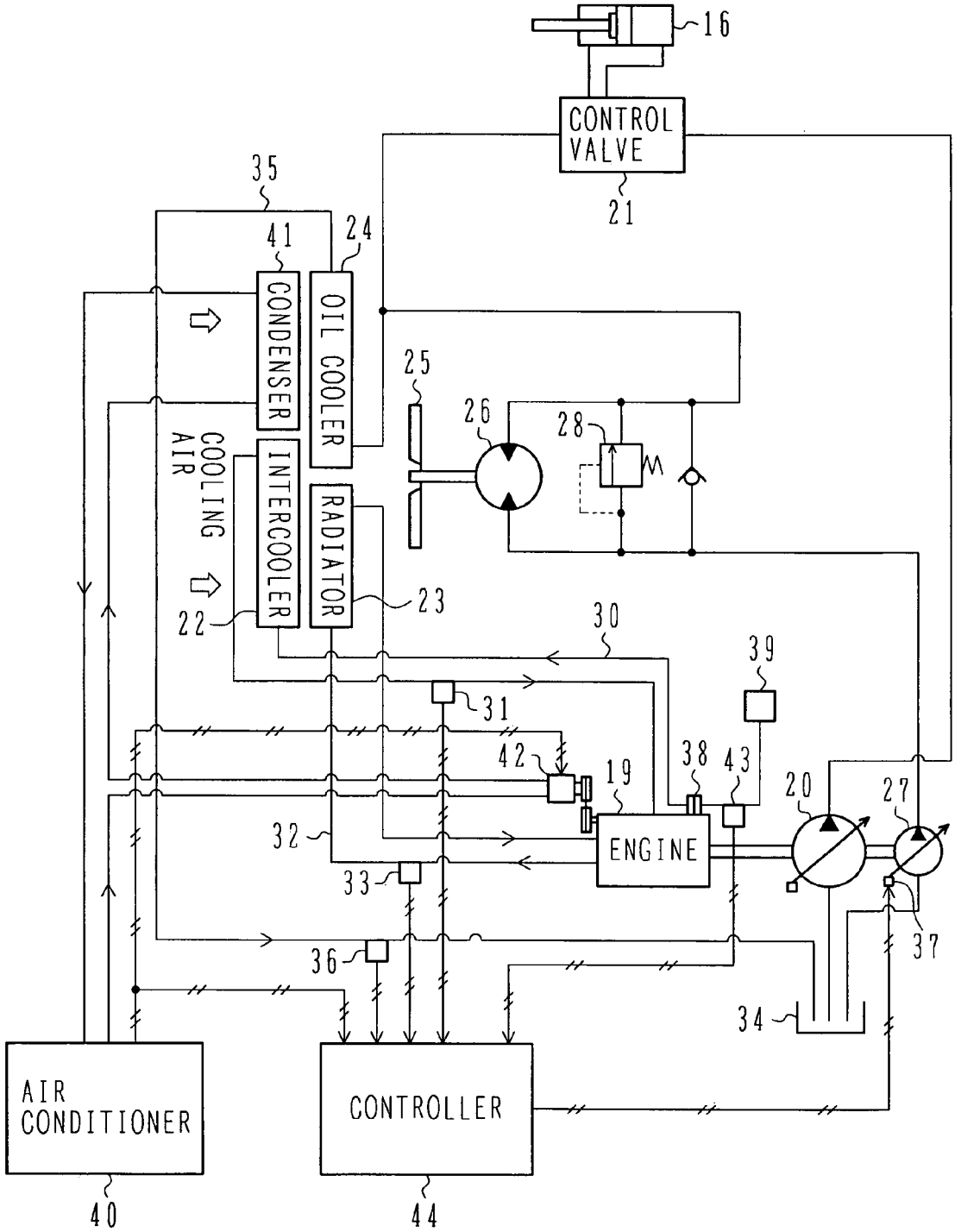
FIG. 7 is a hydraulic circuit diagram showing a second embodiment of the cooling system for the construction machine according to the present invention along with the hydraulic driving system.

FIG. 7 is a hydraulic circuit diagram showing a cooling system for a construction machine according to this second embodiment along with the hydraulic driving system. Note that, in FIG. 7, identical components to those in the first embodiment are denoted by the same reference numerals and a description of those components is omitted here unless specifically required.

In this second embodiment, the cooling system further includes an air conditioner 40 for the cab, a condenser 41 for cooling a coolant of the air conditioner 40, a compressor 42 which is provided to be capable of being connected with and disconnected from an output shaft of the engine 19 and compresses the coolant introduced from the air conditioner 40 for supply to the condenser 41, and an open air temperature sensor 43 which is disposed between the air cleaner 39 and the turbo charger 38 and detects the temperature of open air. The condenser 41 is arranged upstream (left side in FIG. 7) of the radiator 23 and the oil cooler 24 in the direction of flow of the cooling air, and is arranged in side-by-side relation to the intercooler 22.

Though not shown in detail, the air conditioner 40 includes an operation switch capable of being manipulated by an operator, a blower for blowing cooled air into the cab, and a control unit for driving and controlling the compressor 42, the blower, etc. For example, when the operation switch is manipulated into an ON-state, a driving command signal (control signal) for driving the compressor 42 is outputted from the control unit to each of the compressor 42 and a controller 44. In accordance with the driving command signal, the compressor 42 is brought into connection with the output shaft of the engine 19 to be driven therewith.

The controller 44 executes predetermined arithmetic and logical operations on the detected signals inputted from the air temperature sensor 31, the cooling water temperature sensor 33, the working oil temperature sensor 36, the open air temperature sensor 43, etc. based on operation tables (see FIGS. 4-6 described above and FIG. 9 described later for details) which have been set and stored in advance, and it outputs a produced control signal to the displacement control unit 37 for the fan hydraulic pump 27.

Figure 8:
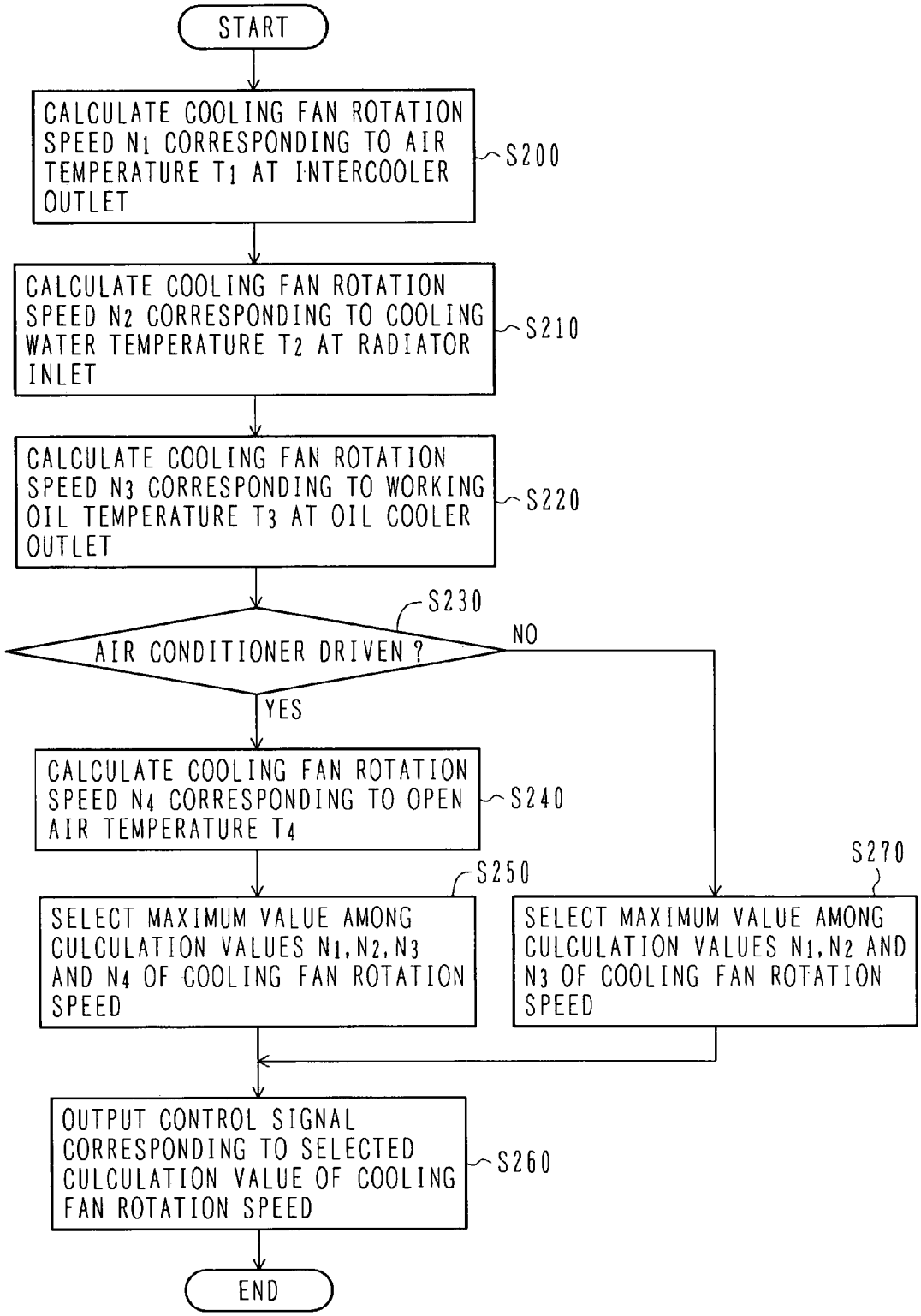
FIG. 8 is a flowchart showing procedures of control processing executed in a controller which constitutes the second embodiment of the cooling system for the construction machine according to the present invention.
Figure 9:
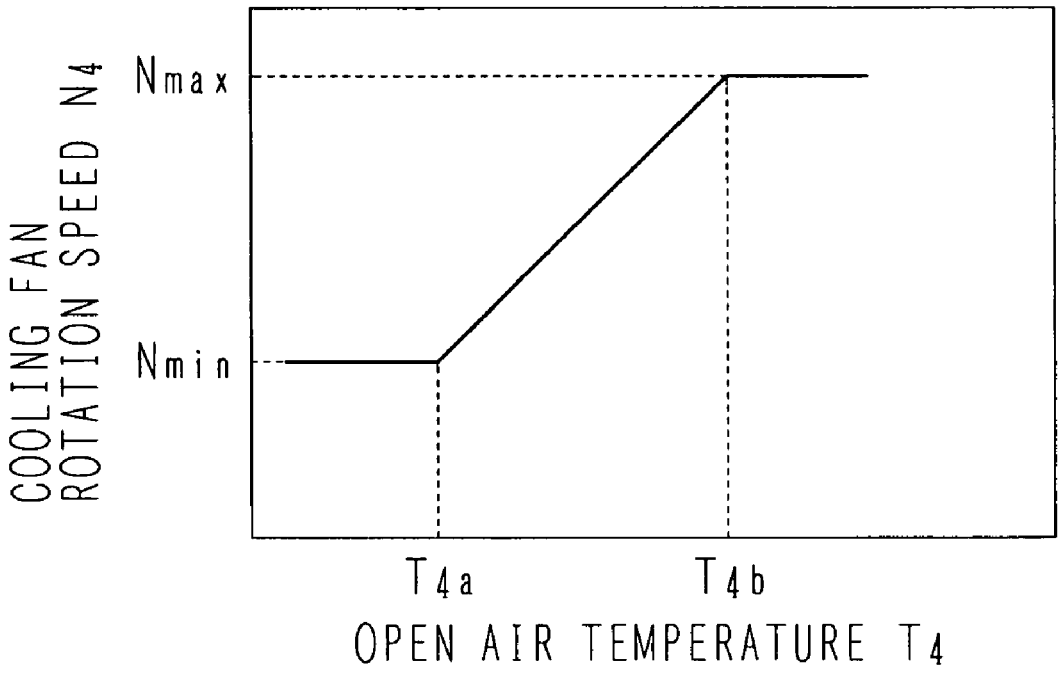
FIG. 9 shows an operation table stored in the controller which constitutes the second embodiment of the cooling system for the construction machine according to the present invention, the table being represented as a characteristic graph plotting the cooling fan rotation speed with respect to the open air temperature.

FIG. 8 is a flowchart showing procedures of control processing executed in the controller 44, and FIG. 9 shows one of the operation tables stored in the controller 44, the table being represented as a characteristic graph plotting the cooling fan rotation speed with respect to the open air temperature.

Referring to FIG. 8, in step 200, the first calculation value $N_1$ of the cooling fan rotation speed is calculated corresponding to the air temperature $T_1$ at the outlet of the intercooler 22, which is inputted from the air temperature sensor 31, based on the above-described operation table shown in FIG. 4. Then, the control flow proceeds to step 210 in which the second calculation value $N_2$ of the cooling fan rotation speed is calculated corresponding to the cooling water temperature $T_2$ at the inlet of the radiator 23, which is inputted from the cooling water temperature sensor 33, based on the above-described operation table shown in FIG. 5. Then, the control flow proceeds to step 220 in which the third calculation value $N_3$ of the cooling fan rotation speed is calculated corresponding to the working oil temperature $T_3$ at the outlet of the oil cooler 24, which is inputted from the working oil temperature sensor 36, based on the above-described operation table shown in FIG. 6.

Then, the control flow proceeds to step 230 in which whether the air conditioner 40 is driven is determined by determining whether the driving command signal for the compressor 42 is inputted from the air conditioner 40. If the air conditioner 40 is driven (i.e., if the compressor 42 is driven), the determination in step 230 is satisfied and the control flow proceeds to step 240. In step 240, a fourth calculation value $N_4$ of the cooling fan rotation speed is calculated corresponding to an open air temperature $T_4$, which is inputted from the open air temperature sensor 43, based on an operation table shown in FIG. 9. More specifically, when the open air temperature $T_4$ is not higher than a first control open air temperature $T_{4a}$, the cooling fan rotation speed $N_4$ is set to a minimum rotation speed $N_{min}$. When the open air temperature $T_4$ is not lower than the second control open air temperature $T_{4b}$, the cooling fan rotation speed $N_4$ is set to a maximum rotation speed $N_{max}$. When the open air temperature $T_4$ is in the range of $T_{4a}<T_4<T_{4b}$, the cooling fan rotation speed $N_4$ is monotonously increased in the range from the minimum rotation speed $N_{min}$ to the maximum rotation speed $N_{max}$ with an increase of the open air temperature $T_4$.

Then, the control flow proceeds to step 250 in which a maximum value among the calculation values $N_1$, $N_2$, $N_3$ and $N_4$ of the cooling fan rotation speed is selected. Thereafter, in step 260, a control signal corresponding to the selected maximum value is produced and outputted to the displacement control unit 37 for the fan hydraulic pump 27. As a result, the fan hydraulic motor 26 is driven in accordance with the delivery displacement of the fan hydraulic pump 27, and the rotation speed of the cooling fan 25 is controlled so that the cooling fan rotation speed selected in step 250 is obtained.

On the other hand, if the air conditioner 40 is not driven in step 230 (i.e., if the compressor 42 is not driven), the determination in step 230 is not satisfied and the control flow proceeds to step 270. In step 270, a maximum value among the calculation values $N_1$, $N_2$ and $N_3$ of the cooling fan rotation speed (i.e., except for the calculation value $N_4$ of the cooling fan rotation speed related to the condenser 41) is selected. Thereafter, in step 260, a control signal corresponding to the selected maximum value is produced and outputted to the displacement control unit 37 for the fan hydraulic pump 27. As a result, the fan hydraulic motor 26 is driven in accordance with the delivery displacement of the fan hydraulic pump 27, and the rotation speed of the cooling fan 25 is controlled so that the cooling fan rotation speed selected in step 270 is obtained.

In the foregoing, the open air temperature sensor 43 constitutes open air temperature detecting means for detecting the temperature of open air, which is stated in claims. Also, the control functions of the controller 44, shown in FIG. 8, constitute control means for, when the air conditioner is driven, receiving detected values from the air temperature detecting means, the cooling water temperature detecting means, the working oil temperature detecting means and the open air temperature detecting means, and outputting a control signal corresponding to a maximum value among the calculation values of the cooling fan rotation speed, which correspond respectively to those detected values, and for, when the air conditioner is stopped, receiving detected values from the air temperature detecting means, the cooling water temperature detecting means, the working oil temperature detecting means and the open air temperature detecting means, and outputting a control signal corresponding to a maximum value among the calculation values of the cooling fan rotation speed, which correspond respectively to those detected values.

Thus, in this second embodiment constructed as described above, when the air conditioner 40 is stopped, the rotation speed of the cooling fan 25 is controlled depending on the air temperature $T_1$ at the outlet of the intercooler 22, the cooling water temperature $T_2$ at the inlet of the radiator 23, and the working oil temperature $T_3$ at the outlet of the oil cooler 24. Accordingly, as in the first embodiment, the cooling air can be reliably produced at a flow rate required for the intercooler 22, the radiator 23, and the oil cooler 24. On other hand, when the air conditioner 40 is driven, the rotation speed of the cooling fan 25 is controlled depending on the air temperature $T_1$ at the outlet of the intercooler 22, the cooling water temperature $T_2$ at the inlet of the radiator 23, the working oil temperature $T_3$ at the outlet of the oil cooler 24, and the open air temperature $T_4$. Accordingly, the cooling air can be reliably produced at a flow rate required for the intercooler 22, the radiator 23, the oil cooler 24, and the condenser 41.

Further, as compared with, for example, the case where the cooling fan directly driven by the engine is provided, this second embodiment is advantageous in preventing a useless increase of the cooling fan rotation speed, and reducing noise of the cooling fan 22 to a lower level. In addition, since the cooling fan is shared by the intercooler, the radiator, the oil cooler, and the condenser, the number of parts can be cut and the noise of the cooling fan 22 can be further reduced as a whole.

While the second embodiment is described above, by way of example, in connection with the case where the controller 44 receives the driving command signal for the compressor 42 from the air conditioner 40 to determine whether the air conditioner 40 is driven, the present invention is not limited to that case. Stated another way, whether the air conditioner 40 is driven may be determined, for example, by receiving a signal corresponding to the ON-state of the operation switch of the air conditioner 40 or a signal corresponding to driving of the blower. Such a modification can also provide similar advantages to those described above.

A third embodiment of the present invention will be described below with reference to FIGS. 10-12. In this third embodiment, when the air conditioner is driven, a lower limit value of the calculation value of the cooling fan rotation speed (hereinafter referred to as a "lower limit value of the cooling fan rotation speed") is set depending on the engine revolution speed.

Figure 10:
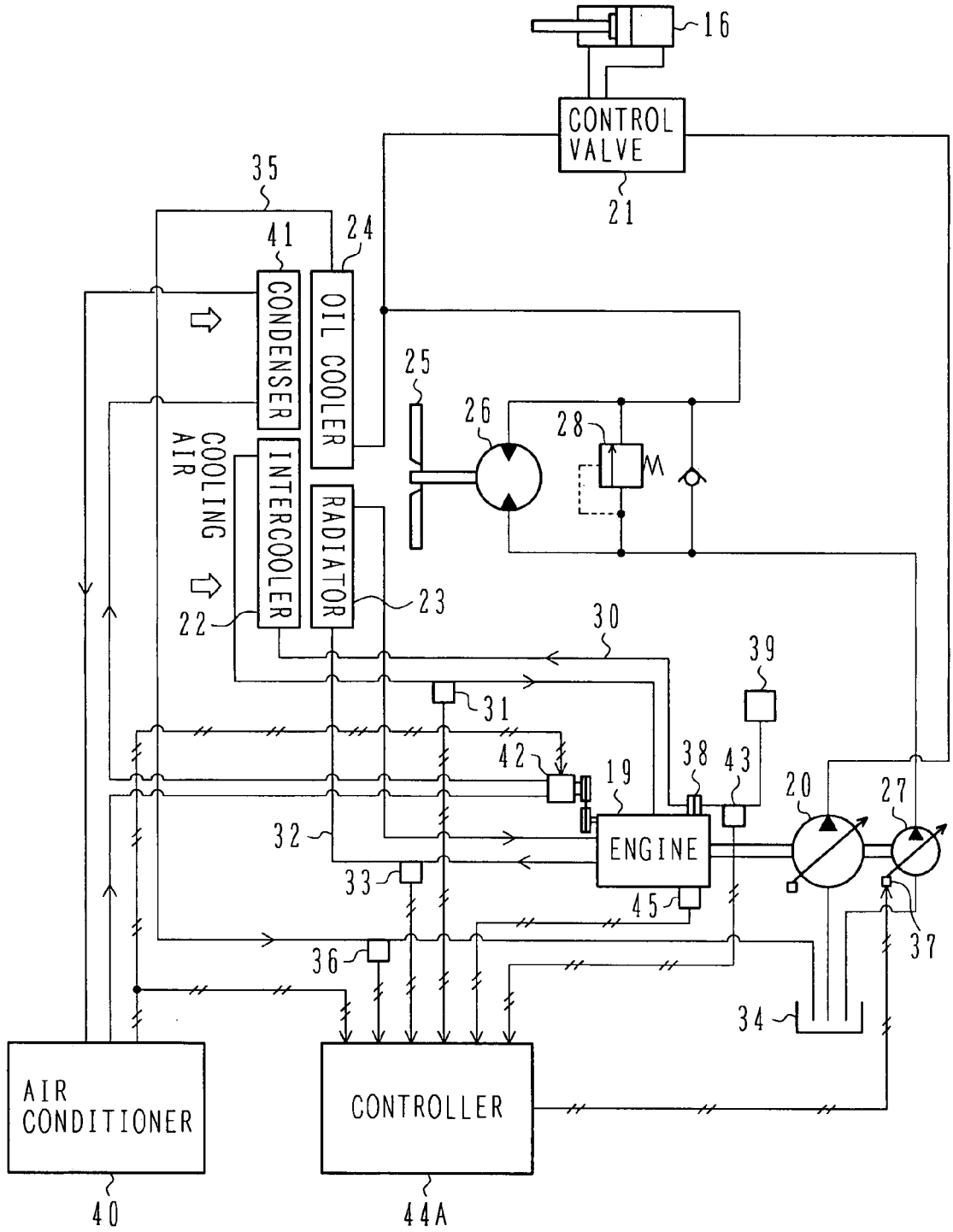
FIG. 10 is a hydraulic circuit diagram showing a third embodiment of the cooling system for the construction machine according to the present invention along with the hydraulic driving system.

FIG. 10 is a hydraulic circuit diagram showing a cooling system for a construction machine according to this second embodiment along with the hydraulic driving system. Note that, in FIG. 10, identical components to those in the first and second embodiments are denoted by the same reference numerals and a description of those components is omitted here unless specifically required.

In this third embodiment, an engine revolution speed sensor 45 (engine revolution speed detecting means) for detecting the revolution speed of the engine 19 is provided and a detected signal from the sensor 45 is outputted to a controller 44A.

The controller 44A executes predetermined arithmetic and logical operations on the detected signals inputted from the air temperature sensor 31, the cooling water temperature sensor 33, the working oil temperature sensor 36, the open air temperature sensor 43, the engine revolution speed sensor 45, etc. based on operation tables (see FIGS. 4-6 and 9 described above and FIG. 12 described later for details) which have been set and stored in advance, and it outputs a produced control signal to the displacement control unit 37 for the fan hydraulic pump 27.

Figure 11:
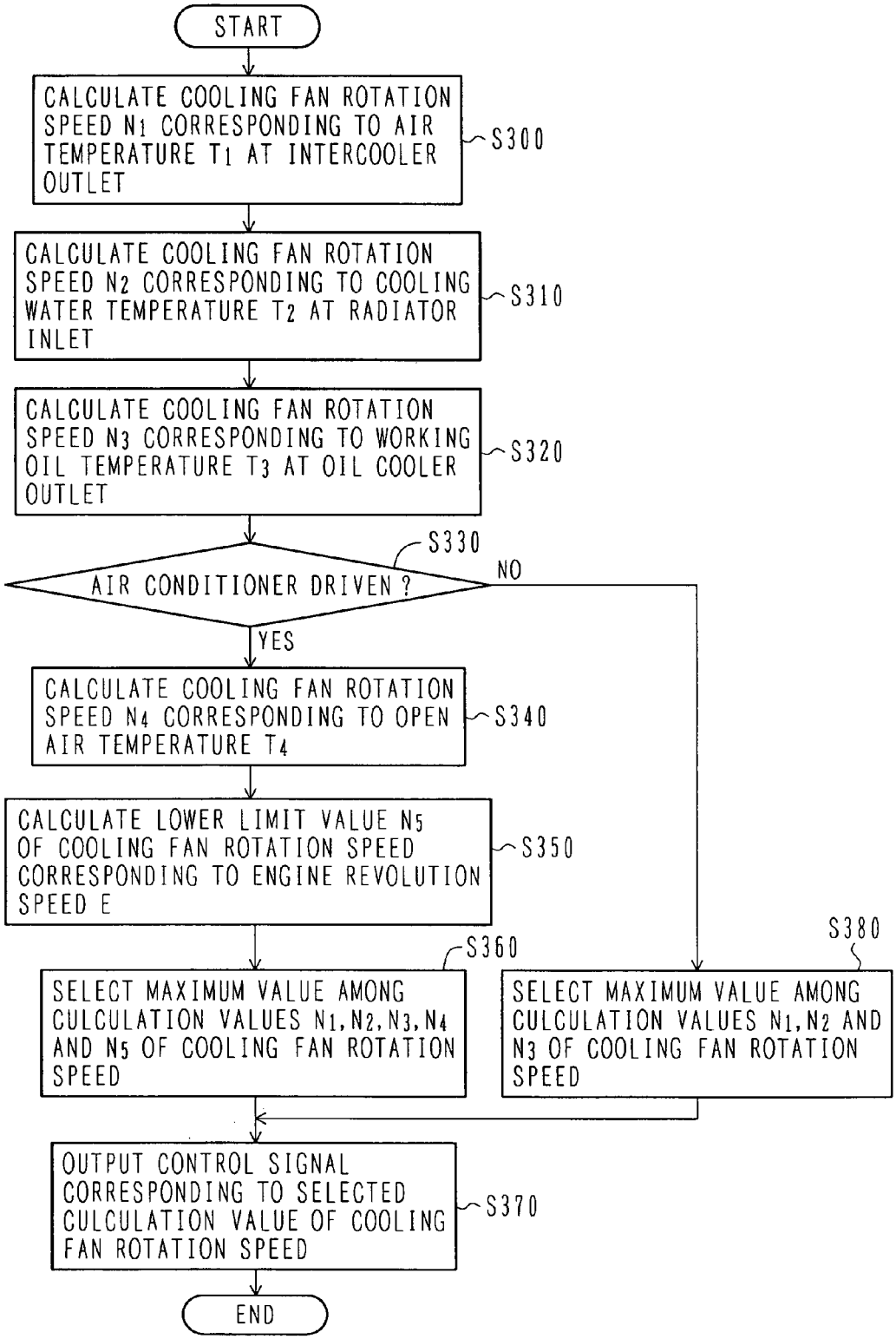
FIG. 11 is a flowchart showing procedures of control processing executed in a controller which constitutes the third embodiment of the cooling system for the construction machine according to the present invention.
Figure 12:
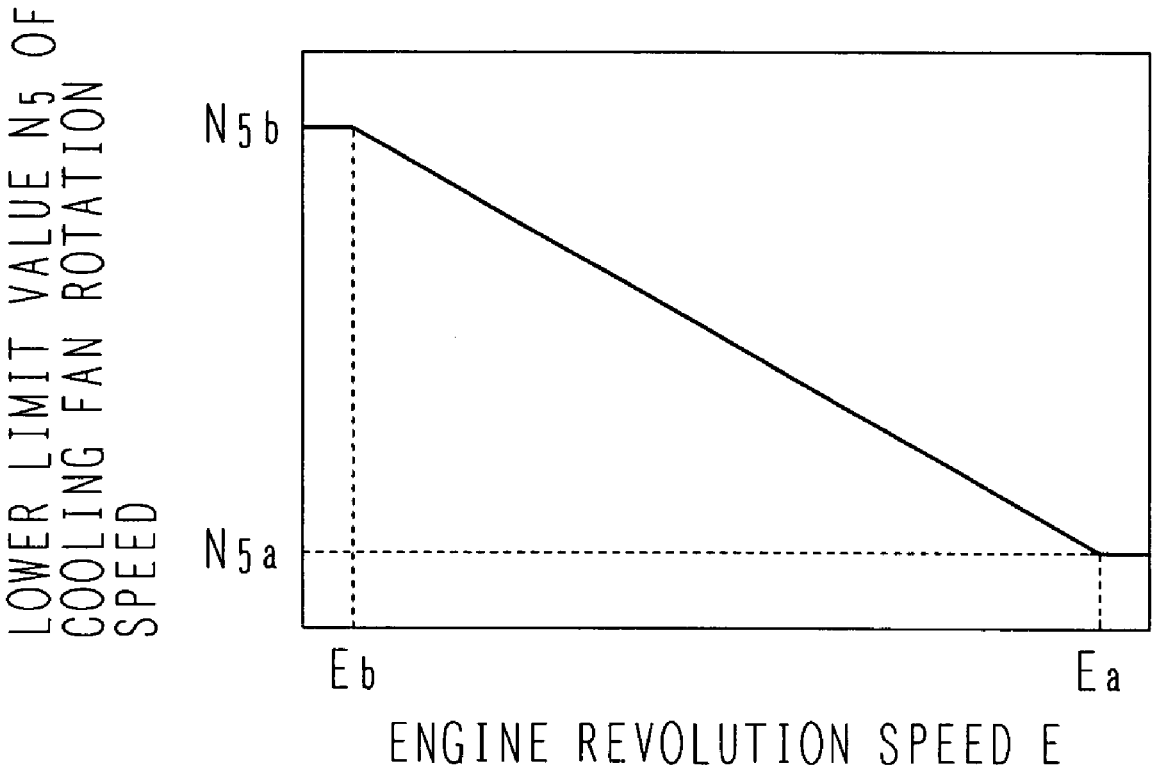
FIG. 12 shows an operation table stored in the controller which constitutes the third embodiment of the cooling system for the construction machine according to the present invention, the table being represented as a characteristic graph plotting a lower limit value of the cooling fan rotation speed with respect to the engine revolution speed.

FIG. 11 is a flowchart showing procedures of control processing executed in the controller 44A, and FIG. 12 shows one of the operation tables stored in the controller 44A, the table being represented as a characteristic graph plotting the lower limit value of the cooling fan rotation speed with respect to the engine revolution speed.

Referring to FIG. 11, in step 300, the first calculation value $N_1$ of the cooling fan rotation speed is calculated corresponding to the air temperature $T_1$ at the outlet of the intercooler 22, which is inputted from the air temperature sensor 31, based on the above-described operation table shown in FIG. 4. Then, the control flow proceeds to step 310 in which the second calculation value $N_2$ of the cooling fan rotation speed is calculated corresponding to the cooling water temperature $T_2$ at the inlet of the radiator 23, which is inputted from the cooling water temperature sensor 33, based on the above-described operation table shown in FIG. 5. Then, the control flow proceeds to step 320 in which the third calculation value $N_3$ of the cooling fan rotation speed is calculated corresponding to the working oil temperature $T_3$ at the outlet of the oil cooler 24, which is inputted from the working oil temperature sensor 36, based on the above-described operation table shown in FIG. 6.

Then, the control flow proceeds to step 330 in which whether the air conditioner 40 is driven is determined. If the air conditioner 40 is driven, the determination in step 330 is satisfied and the control flow proceeds to step 340. In step 340, the fourth calculation value $N_4$ of the cooling fan rotation speed is calculated corresponding to the open air temperature $T_4$, which is inputted from the open air temperature sensor 43, based on the above-described operation table shown in FIG. 9. In practice, because the delivery displacement of the fan hydraulic pump 27 varies depending on the engine revolution speed E, the cooling fan rotation speed also varies depending on the engine revolution speed if the control signal from the controller 44A is the same.

Therefore, the control flow proceeds to step 350 in which a lower limit value $N_5$ of the cooling fan rotation speed is calculated corresponding to the engine revolution speed E, which is inputted from the engine revolution speed sensor 45, based on the operation table shown in FIG. 12. More specifically, when the engine revolution speed E is not lower than a first engine revolution speed $E_a$ (e.g., engine revolution speed during high idle operation), the lower limit value $N_5$ of the cooling fan rotation speed is set to a first lower limit revolution speed $N_{5a}$ (e.g., a minimum revolution speed $N_{min}$ during the high idle operation). When the engine revolution speed E is not higher than a second engine revolution speed $E_b$ (e.g., engine revolution speed during low idle operation), the lower limit value $N_5$ of the cooling fan rotation speed is set to a second lower limit revolution speed $N_{5b}$ (e.g., a maximum revolution speed $N_{max}$ during the low idle operation). When the engine revolution speed E is in the range of $E_a<E<E_b$, the lower limit value $N_5$ of the cooling fan rotation speed is monotonously increased in the range from the first lower limit revolution speed $N_{5a}$ to the second lower limit revolution speed $N_{5b}$ with a decrease of the engine revolution speed E.

Then, the control flow proceeds to step 360 in which a maximum value among the calculation values $N_1$, $N_2$, $N_3$, $N_4$ and $N_5$ of the cooling fan rotation speed is selected. Thereafter, in step 370, a control signal corresponding to the selected maximum value is produced and outputted to the displacement control unit 37 for the fan hydraulic pump 27. As a result, the fan hydraulic motor 26 is driven in accordance with the delivery displacement of the fan hydraulic pump 27, and the rotation speed of the cooling fan 25 is controlled so that the cooling fan rotation speed selected in step 360 is obtained.

On the other hand, if the air conditioner 40 is not driven in step 330, the determination in step 330 is not satisfied and the control flow proceeds to step 380. In step 380, a maximum value among the calculation values $N_1$, $N_2$ and $N_3$ of the cooling fan rotation speed (i.e., except for the calculation value $N_4$ of the cooling fan rotation speed related to the condenser 41) is selected. Thereafter, in step 370, a control signal corresponding to the selected maximum value is produced and outputted to the displacement control unit 37 for the fan hydraulic pump 27. As a result, the fan hydraulic motor 26 is driven in accordance with the delivery displacement of the fan hydraulic pump 27, and the rotation speed of the cooling fan 25 is controlled so that the cooling fan rotation speed selected in step 380 is obtained.

Thus, in this third embodiment constructed as described above, as in the second embodiment, when the air conditioner 40 is stopped, the cooling air can be reliably produced at a flow rate required for the intercooler 22, the radiator 23, and the oil cooler 24. When the air conditioner 40 is driven, the cooling air can be reliably produced at a flow rate required for the intercooler 22, the radiator 23, the oil cooler 24, and the condenser 41. Further, as compared with, for example, the case where the cooling fan directly driven by the engine is provided, the noise of the cooling fan 22 can be reduced to a lower level.

Moreover, in this third embodiment, when the air conditioner 40 is driven, the lower limit value $N_5$ of the cooling fan rotation speed is calculated so as to increase with a decrease of the engine revolution speed E, thus performing control such that the cooling fan rotation speed is not reduced beyond the lower limit value $N_5$. It is hence possible to suppress deterioration of the cooling capability of the condenser 41, etc. which is otherwise caused due to a lowering of the engine revolution speed E.

While the third embodiment is described above, by way of example, in connection with the case where the controller 44A executes the control processing to select the maximum value among the calculation values $N_1$, $N_2$, $N_3$, $N_4$ and $N_5$ of the cooling fan rotation speed and to output the corresponding control signal when the air conditioner 40 is driven, the present invention is not limited to that case. Stated another way, the control processing may be modified, for example, as follows. The maximum value among the calculation values $N_1$, $N_2$, $N_3$ and $N_4$ of the cooling fan rotation speed is selected and, if the selected calculation value of the cooling fan rotation speed is one of $N_1$, $N_2$ and $N_3$, a control signal corresponding to the selected calculation value is outputted. If the selected calculation value of the cooling fan rotation speed is $N_4$, a larger one of the calculation value $N_4$ and the lower limit value $N_5$ of the cooling fan rotation speed is selected, and a control signal corresponding to the selected value is outputted. Such a modification can also provide similar advantages to those described above.

While the third embodiment is described above, by way of example, in connection with the case where the controller 44A executes the control processing to select the maximum value among the calculation values $N_1$, $N_2$ and $N_3$ of the cooling fan rotation speed for the intercooler 22, the radiator 23, and the oil cooler 24 and to output the corresponding control signal when the air conditioner 40 is stopped, the present invention is not limited to that case. Stated another way, the control processing may be modified, for example, as follows. The lower limit value $N_5$ of the cooling fan rotation speed is calculated corresponding to the engine revolution speed E detected by the engine revolution speed sensor 45, a maximum value among the calculation values $N_1$, $N_2$ and $N_3$ and the lower limit value $N_5$ of the cooling fan rotation speed is selected, and a control signal corresponding to the selected value is outputted. Further, the first embodiment may be modified such that the engine revolution speed sensor is provided and the control processing is performed in a similar manner. Those modifications can also provide similar advantages to those described above.

While the above description is made, by way of example, in connection with the case where the operation tables stored in the controller 29, shown in FIGS. 4-6 and 9, are set such that the rotation speed of the cooling fan 25 is continuously changed depending on the air temperature $T_1$, the cooling water temperature $T_2$, the working oil temperature $T_3$, and the open air temperature $T_4$, and where the rotation speed of the cooling fan 25 is continuously changed by the variable-displacement fan hydraulic pump 27, the present invention is not limited that case. Stated another way, the present invention may be modified, for example, as follows. The operation tables stored in the controller 29 are set such that the rotation speed of the cooling fan 25 is stepwisely changed depending on the air temperature $T_1$, the cooling water temperature $T_2$, the working oil temperature $T_3$, and the open air temperature $T_4$, and the rotation speed of the cooling fan 25 is stepwisely changed by the variable-displacement fan hydraulic pump 27. Such a modification can also provide similar advantages to those described above.

While the above description is made, by way of example, in connection with the case where the rotation speed of the cooling fan 25 is controlled by controlling the delivery displacement of the variable-displacement fan hydraulic pump 27, the present invention is not limited to that case. Stated another way, the present invention may be modified, for example, as follows. A constant-displacement fan hydraulic pump and a variable-displacement fan hydraulic motor are provided, and the rotation speed of the cooling fan is controlled by controlling the displacement of the variable-displacement fan hydraulic motor. Such a modification can also provide similar advantages to those described above.

In addition, while the above description is made, by way of example, in connection with the case of the construction machine being the large-sized hydraulic excavator, the present invention is not limited to such an application. The present invention can also be applied to other construction machines, such as a large-sized crawler crane and a wheel loader, and can provide similar advantages in those applications as well.

The invention claimed is:

1. A cooling system for a construction machine comprising:

an intercooler for cooling compressed air pressurized by a turbo charger which is mounted on an engine;

a radiator for cooling water to cool said engine;

an oil cooler for cooling working oil for a hydraulic driving system;

a condenser for cooling a coolant of an air conditioner for a cab;

a cooling fan for producing cooling air introduced to said intercooler, said radiator, said oil cooler and said condenser;

a fan hydraulic motor for driving said cooling fan;

a fan hydraulic pump for delivering a hydraulic fluid to said fan hydraulic motor;

air temperature detecting means for detecting an air temperature ($T_1$) at an outlet of said intercooler;

cooling water temperature detecting means for detecting a temperature ($T_2$) of cooling water for said radiator;

working oil temperature detecting means for detecting a temperature ($T_3$) of working oil for said oil cooler;

open air temperature detecting means for detecting an open air temperature ($T_4$);

engine revolution speed detecting means for detecting an engine revolution speed (E) of said engine; and control means for controlling the rotation speed of said cooling fan, wherein, when said air conditioner is driven, said control means calculates a lower limit value ($N_5$) of the cooling fan rotation speed that increases with a decrease of the engine revolution speed (E) detected by said engine revolution speed detecting means, and outputs a control signal corresponding to a maximum value among the lower limit value ($N_5$) of the cooling fan rotation speed and calculation values ($N_1$, $N_2$, $N_3$, $N_4$) of cooling fan rotation speed, which correspond respectively to values ($T_1$, $T_2$, $T_3$, $T_4$) detected by said air temperature detecting means, said cooling water temperature detecting means, said working oil temperature detecting means and said open air temperature detecting means, when said air conditioner is stopped, said control means outputs a control signal corresponding to a maximum value among the calculation values ($N_1$, $N_2$, $N_3$) of the cooling fan rotation speed which correspond respectively to the detected values ($T_1$, $T_2$, $T_3$) by said air temperature detecting means, said cooling water temperature detecting means, and said working oil temperature detecting means.

2. The cooling system for the construction machine according to claim 1, wherein said control means controls the rotation speed of said cooling fan by variably controlling delivery displacement of said fan hydraulic pump.

3. The cooling system for the construction machine according to claim 1, wherein said control means controls the rotation speed of said cooling fan by variably controlling displacement of said fan hydraulic motor.

4. The cooling system for the construction machine according to claim 1, wherein said control means controls the cooling fan rotation speed to be continuously changed.

5. The cooling system for the construction machine according to claim 1, wherein said control means controls the cooling fan rotation speed to be stepwisely changed.

* * * * *